United States Patent [19]

Kondo et al.

[11] Patent Number: 4,581,257

[45] Date of Patent: Apr. 8, 1986

[54] METHOD OF PRODUCING CAST COATED PAPER

[75] Inventors: Hiromasa Kondo, Higashi-Osaka; Hitoshi Yamahira, Takatsuki; Kazuo Kojima, Minoo; Mikio Takahashi, Takatsuki, all of Japan

[73] Assignee: Kanzaki Paper Mfg. Co., Ltd., Tokyo, Japan

[21] Appl. No.: 619,148

[22] PCT Filed: Sep. 26, 1983

[86] PCT No.: PCT/JP83/00316

§ 371 Date: May 24, 1984

§ 102(e) Date: May 24, 1984

[87] PCT Pub. No.: WO84/01396

PCT Pub. Date: Apr. 12, 1984

[30] Foreign Application Priority Data

Sep. 28, 1982 [JP] Japan ..... 57-170774

[51] Int. Cl.[4] ..... B05D 3/02; B05D 3/12

[52] U.S. Cl. ..... 427/336; 427/362; 427/374.2; 427/374.3; 427/398.3

[58] Field of Search ..... 427/336, 362, 374.2, 427/374.3, 398.3

[56] References Cited

U.S. PATENT DOCUMENTS

| | | | |
|---|---|---|---|
| 2,316,202 | 4/1943 | Warner | 117/102 |
| 2,759,847 | 8/1956 | Frost et al. | 117/64 |
| 3,377,192 | 4/1968 | Kirk et al. | 117/64 |
| 3,676,184 | 7/1972 | Spearin et al. | 117/68 |
| 3,982,056 | 9/1976 | Holder | 427/362 X |

FOREIGN PATENT DOCUMENTS

| | | |
|---|---|---|
| 888099 | 12/1971 | Canada . |
| 903589 | 6/1972 | Canada . |
| 47-12203 | 4/1972 | Japan . |

OTHER PUBLICATIONS

Takashi, Kadoya et al., Paper Science, p. 267, Line 14 to p. 269, Line 1, Nov. 25, 1977.

*Primary Examiner*—Michael R. Lusignan

*Attorney, Agent, or Firm*—Pennie & Edmonds

[57] ABSTRACT

A method of producing cast coated paper by a rewet or gel-casting method, which comprises wetting the back surface of the paper with water in an amount of 1 to 30 g/m$^2$ at or before a pressing nip for pressing said coated layer against the highly polished finishing surface of a drum, thereby effectively preventing the cast coated paper from forming a CD curl (cross direction curl).

6 Claims, 2 Drawing Figures

METHOD OF PRODUCING CAST COATED PAPER

TECHNICAL FIELD

This invention relates to a method of producing cast coated paper. More particularly, the invention relates to a method of producing cast coated high-gloss paper having substantially no warp or curl at a high speed by a rewet casting method or a gel-casting method.

BACKGROUND ART

Conventional methods of producing cast coated high-gloss paper for printing include a wet casting method adapted to finish a glazed coated layer by pressing the wet state coated layer comprising a mineral pigment and an adhesive on the heated highly polished finishing surface (disclosed, for example, in Japanese Patent Publications Nos. 3407/1953 and 25160/1963), a rewet casting method adapted to once dry a coated layer of wet state, to then plasticize the layer with a rewetting liquid and to press the layer on a heated finishing surface (disclosed, for example, in U.S. Pat. No. 2,759,847, Japanese Patent Publication No. 38,005/1973 and Japanese Patent Laid-open Publication No. 102,111/1976), and a gel-casting method adapted to finish a glazed coated layer by pressing the gel state coated layer on the heated finishing surface (disclosed, for example, in Japanese Patent Publications Nos. 15,751/1963, 7,207/1965, U.S. Pat. No. 3,377,192, Japanese Patent Laid-open Publications Nos. 40,410/1976 and 51,896/1982).

In any of these conventional casting methods, coating composition containing as main components, a mineral pigment and an adhesive is applied to a paper web, the wet and plasticized coating layer on paper web is pressed against the heated highly polished finishing surface of the drum by means of a press roll at a pressure higher than the vapor pressure of water, dried, and released from the drum. However, in the wet casting method, the coated layer is frequently damaged due to abrupt evaporation of water when the paper is pressed against the surface of the drum at a temperature of higher than 90° C. As a result, if the pressing pressure is made considerably higher than the vapor pressure in order to prevent the coated layer from being damaged, it is impossible to maintain a sufficient amount of coating composition on the paper web, and a breakage or crack of paper sometimes occurs. Thus, in the conventional wet casting method, the temperature of the drum cannot be raised higher than 90° C., and the operation has to be made at a low speed.

U.S. Patent No. 2,316,202 discloses a wet casting method using a backing roll, in which method a water pool is retained between a pressing roll having a plane(smooth) surface and the backing roll, thereby cleaning and removing coating composition adhered to the pressing roll. However, since this method prevents the transfer of water to the paper by the nip pressure of the pressing and backing rolls, the paper cannot be wetted. In Canadian Patent No. 888,099, a pressing roll is brought into contact with the wet surface of a roll to clean the surface of the pressing roll, and the back surface of the paper is wetted by the water adhered to the pressing roll, so as to ensure the intimate contact of the paper with the surface of the drum. However, since the surface of the pressing roll is plane in this art, the back surface of the paper cannot be wetted to such a degree as intended by this invention.

On the other hand, in conventional rewet casting method and gel-casting method, the coated layer before being pressed against the highly polished surface of the drum is once dried and gelled. Thus, the coated layer is not damaged as in the wet casting method even if the layer is pressed at a high pressure by the drum heated at a temperature higher than 90° C. Therefore, a cast coated paper of high quality can be produced at a high speed. However, the cast coated paper thus obtained by the high temperature and high pressure casting method forms, after being released from the surface of the drum, a curl such that the paper is curled with the cross direction of the paper as the axis of the curl, the high-gloss cast finished surface being on the outside of the curl and the back surface (uncoated or coated surface) being on the inside of the curl (Such a curl will hereinafter be referred to as "CD curl".). The CD curl causes troubles in paper feed in a multicolor printing machine and seriously affects the efficiency of printing.

In order to obviate this CD curl, moisture control unit, a humidifier or a curl breaker is used in some methods. In any of these methods, it is necessary to wet the high gloss surface or squeeze it with a roll, the gloss and the smoothness of the cast coated paper are seriously reduced. In addition, the CD curl feasibly occurs as the temperature of the drum is raised, and particularly the tendency of causing the CD curl is very strong in casting at a temperature higher than 100° C. Even if the pressing pressure is increased, the tendency of causing the CD curl increases. In the conventional rewet casting method in which the operation at a higher temperature of the drum and at a higher pressure of the pressing roll is desired so as to obtain excellent cast coated paper, this curl may be a fatal drawback.

In view of above-described present status, the inventors of the present invention have studied to prevent the CD curl on the basis of their long experience in the production of the cast coated paper. Particularly, the inventors have paid attention to the fact that the CD curl seldom occurs on art paper and coated paper for printing, nor in a wet casting method for producing cast coated paper but it occurs particularly in the rewet casting method and the gel-casting method which are carried out at a high temperature and a high pressure. Study for the prevention of the CD curl has been made. As a result, it is concluded that such a CD curl occurs due to the abrupt moisture content gradient in the thickness direction of base paper produced when the wet coated layer is pressed against the surface of the heated drum at a high temperature and a high pressure. In ordinary art paper and coated paper, moisture within the coated layer evaporates from both sides of the paper, and therefore extreme moisture content gradient does not occur. In the wet casting method in which moisture within the coated layer evaporates through the base paper layer from the back surface, the temperature of the drum and the pressure of the pressing roll are low and the coated layer containes much moisture, thus abrupt moisture content gradient not ocurring in the thickness direction of the base paper. In the rewet casting method and gel casting method, the moisture is abruptly evaporated by high temperature high pressure and shifted to the back surface of the base paper when the coated layer is pressed against the surface of the heated drum. Therefore, an abrupt moisture content gradient occurs in the thickness direction of the base paper when the coated layer is pressed, more moisture being contained in the coated layer of the base paper, less moisture being contained in the back surface thereof. As a result, fiber in the coated layer, i.e. the surface to be finished by casting is stretched as compared with fiber in the back surface. In addition, since the coated layer is squeezed by the high pressure of the pressing roll in the state that the moisture content gradient takes place in this manner, the fiber in the finished side is more stretched and the CD curl is aggravated.

The inventors of the present invention have concluded that if the above-described moisture content gradient in the thickness direction of the base paper is eliminated it will be possible to prevent the CD curl which has been considered to be the greatest drawback in the high temperature and high pressure casting method such as a conventional rewet casting method. The inventors have successfully eliminated the above-described moisture content gradient by wetting the back surface of the paper at or before the pressing nip between the pressing roll and the drum.

DISCLOSURE OF THE INVENTION

The present invention provides a method of producing cast coated paper which comprises gelling or rewetting after drying a coated layer containing, as main components, a pigment and an adhesive, and pressing the coated layer against the surface of a heated drum to obtain high gloss surface, characterized by wetting the back surface of the paper at or before a pressing nip for pressing the coated surface against the surface of the drum.

In a method of producing cast coated paper of the present invention, a coating composition used for forming a coated layer contains, as main components, a pigment and an adhesive in the same manner as the conventional composition for cast coated paper. The pigment usable comprises one or more of conventional pigments for coated paper such as clay, kaolin, aluminum hydroxide, calcium carbonate, titanium oxide, barium sulfate, zinc oxide, satin white, and plastic pigment. The adhesive usable comprises one or more of conventional adhesives for coated paper such as casein, soybean protein, proteins extracted from methanol-or acetic acid-assimilative single cells, and like proteins; conjugated diene polymerlatexes such as styrene-butadiene copolymer and methylmethacrylate-butadiene copolymer, acrylic polymer latexes such as acrylic acid ester and/or methacrylic acid ester polymer or copolymer, vinyl polymer latexes such as ethylene-vinyl acetate copolymer, and alkaline soluble or alkaline insoluble polymer latexes obtained by the functional group modification of these polymers by functional group-containing monomer such as carboxylic group or other group; synthetic resins such as polyvinyl alcohol, olefinmaleic anhydride resin, and melamine resin; starches such as cationic starch and oxidized starch; cellulose derivatives such as carboxymethylcellulose and hydroxyethyl-cellulose. The quantity of the adhesive to be used is 5 to 50 parts , generally 10 to 30 parts, by weight for 100 parts by weight of the pigment.

Auxiliary agents such as anti-foaming agent, dye stuff, releasing agent and fluidity modifier are used if necessary.

In the present invention the coating composition is applied in one or more layers onto base paper by means of an on-machine or off-machine coater such as a blade coater, an air knife coater, a roll coater, a brush coater, a curtain coater, a Champflex coater, a bar coater, a gravure coater or a size pressing coater. The solid concentration of the coating composition of this case is in general 40 to 70% by weight, preferably 45 to 65% by weight in view of runnability.

The base paper may be paper base or board base having a basis weight of 30 to 400 g/m$^2$ used for coated paper or cast coated paper for printing. Such paper is made at an acid or alkaline pH, and medium-grade base paper which contains approx. 10% or more by weight of high yield pulp such as mechanical pulp may also be used. Also usable as the base paper is coated paper applied with a pigment coating on the back surface of cast coated layer or preliminarily coated paper. The amount of a coating composition applied to the base paper is 10 to 50 g/m$^2$ (dry basis), and is most preferably 15 to 35 g/m$^2$ ( dry basis) in view of the paper quality and cast coating speed of the cast coated paper.

The coated layer formed on the base paper is gelled by an acid, salt or heating in the same manner as the conventional method, further rewetted as required, or once dried (or semidried) and rewetted, then pressed against the highly polished finishing surface of a heated drum. Preferable rewetting liquid other than water includes aqueous solution or emulsion which contains approx. 0.01 to 3% by weight of a releasing agent such as polyethylene emulsion, fatty acid soap, calcium stearate, microcrystalline wax, surface-active agent and sulfonated oil.

In a method of producing such cast coated paper according to the present invention, the back surface of the paper is wetted in advance before the rewetted coated layer is pressed against the surface of the drum as described above. The quantity of water to be used for wetting may be adjusted according to the temperature of the drum, the basis weight of the paper, the speed of casting, etc. However, if the quantity of the water is less than 1 g per square meter of the base paper, the CD curl cannot be substantially prevented, while if the quantity exceeds 30 g/m$^2$, the CD curl is prevented but the paper is liable to be broken when it is pressed against the surface of the drum or the casting speed is reduced. Therefore, it is preferable to wet the paper with 1 to 30 g/m$^2$, most preferably 3 to 15 g/m$^2$, of water. The wetting means is not limited, but normally includes a spray, a nozzle, a gravure roll, or a plane roll. When the back surface of the paper is wetted before the pressing nip, the strength of the paper may be decreased, and therefore the amount of the water for wetting should not exceed 20 g/m$^2$. The water to be used may include aqueous liquid such as starches, proteins, waxes, sizing agents, synthetic resin, dye, surfactant, pigment for the purpose of improving the back surface water repellarcy, sizing adaptability, paper strength, printability and coloring properties, and it is also possible to use the same aqueous liquid as the rewetting liquid for the coated layer. After the back surface of the paper is wetted before the pressing nip, the amount of water may be adjusted by means of a drying unit so as to prevent the strength of the paper from decreasing. In this case it is necessary to adjust the drying so that the quantity of water at the press nip does not become less than 1 g/m$^2$.

The heated drum used in this invention will be briefly described. The drum has a diameter of 1000 to 5000 mm, more preferably 1200 to 3600 mm in view of the operation. The surface temperature of the drum is 90° C. or higher, more preferably 100° to 160° C. in view of the paper quality and runnability. The pressing roll for pressing the coated paper against the surface of the drum may be a rubber coated roll having a diameter of about 200 to 1500 mm, more preferably 300 to 900 mm. The pressure of the pressing roll for pressing the coated paper may be approx. 30 to 350 kg/cm, more preferably 80 to 250 kg/cm.

According to the present invention, high-gloss coated paper having no CD curl or warp can be obtained even at a high casting speed of above 50 m/min by wetting the back surface of the paper at or before the pressing nip in a high temperature and high pressure casting method such as the conventional rewet casting method or gel-casting method.

Various conventional devices known in the field of producing coated paper, such as a water applicator by a roll, an electrostatic humidifier or a steam humidifier may also be used in the method of the present invention for the purpose of moistening the finished cast coated paper or adjusting the moisture thereof in a range which does not obstruct the effects or advantages of the present invention.

BEST MODE FOR CARRYING OUT THE INVENTION

Figure 1:
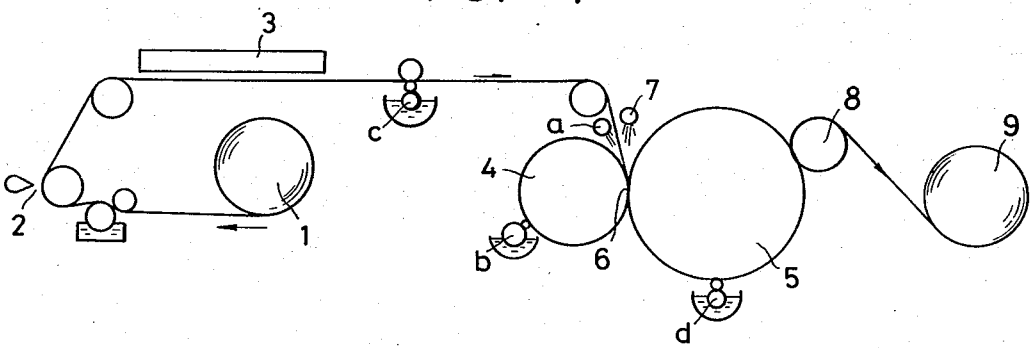
FIGS. 1 and 2 are schematic sectional views showing a cast finishing apparatus used in the examples and comparison examples of the present invention.

The present invention will be described with reference to examples and comparison examples. The invention is not limited to these examples. The parts and percentage in the examples and comparison examples designate parts and percentage by weight, unless otherwise specified.

EXAMPLES 1 to 6, COMPARISON EXAMPLES 1 to 3

90 parts of clay for coating and 10 parts (solid content) of satin white dispersion were dispersed by means of a Cowles dissolver so as to prepare a pigment slurry having a concentration of 62%. 0.5 part of octyl alcohol as an anti-foaming agent, and 20 parts of casein aqueous solution having a concentration of 15% and 20 parts (solid content) of butadiene-methylmethacrylate copolymer latex as adhesives were mixed in said slurry so as to obtain a coating composition having a solid concentration of 45%. This coating composition had a pH value of 9.5 and a viscosity of 360 cps (measured by a Brookfield viscometer at 60 r.p.m. and 20° C.). A casting was carried out with the coating composition by means of an apparatus shown in FIG. 1. The coating composition was applied by means of an air knife coater 2 onto base paper 1 having a basis weight of 100 g/m$^2$ so that the dry coating weight was 22 g/m$^2$, and the paper was dried by an air foil dryer 3 so that the moisture content of the paper became 6%. Then, the paper was passed through a pressing nip 6 formed by a rubber-coated pressing roll 4 having a diameter of 750 mm and a chromium-plated casting drum 5 having a diameter of 1220 mm, the coated layer being rewetted with an aqueous liquid containing 0.5% calcium stearate supplied from a nozzle 7 the paper being pressed to a casting drum 5 at a pressing pressure of 150 kg/cm. After drying, the paper was released from the drum 5 a takeoff roll 8, and wound into a rolled paper 9.

The position for wetting the coated paper is shown in FIG. 1. In Examples 1 to 3, the back surface of the paper was wetted at the pressing nip 6 by means of a spray (a)or a water applicator (b) comprising a 140-mesh gravure roll, a pickup roll and a water pool. In Examples 4 and 5, the back surface of the paper was wetted before the pressing nip 6 by means of a water applicator (c) comprising a plane roll, a pickup roll (the clearance between the rolls =0.2 mm) and a water pool. In Example 6, both the spray (a)and the water applicator (c) were used. In Comparison Example 1, the back surface of the paper was not wetted at all. In Comparison Example 2, the back surface of the paper was wetted by means of a water applicator comprising a 225-mesh gravure roll, a pickup roll and a water pool. In Comparison Example 3, the back surface of the paper which had passed through the pressing nip 6 was wetted by means of a water applicator (d) comprising a plane roll, a pickup roll (the clearance between the rolls =0.2 mm) and a water pool.

The amount of water applied to the back surface of the paper, the temperature of the drum, the casting speed and the occurence of CD curl of the cast coated paper obtained are shown in Table 1. As apparent from of Table 1, the occurrence of CD curls in the Examples of the present invention was extremely decreased as compared with the Comparison Examples. The gloss of the cast finished surface of all the cast coated paper obtained was 90±2 at 75°.

TABLE 1

| | Examples | | | | | | Comparison Examples | | |
|---|---|---|---|---|---|---|---|---|---|
| | 1 | 2 | 3 | 4 | 5 | 6 | 1 | 2 | 3 |
| Wetting position (FIG. 1) | a | a | b | c | c | a + b | non | b | d |
| Quantity of water (g/m$^2$) | 8 | 3 | 2 | 13 | 10 | 20 | 0 | 0.5 | 13 |
| Temperature of drum (°C.) | 125 | 125 | 125 | 125 | 135 | 125 | 125 | 125 | 125 |
| Casting speed (m/min.) | 63 | 65 | 65 | 58 | 80 | 50 | 65 | 65 | 50 |
| CD curl* | flat | 20 | 15 | flat | 20 | flat | 2> | 2> | 2> |

*CD curl is designated by the value of the radius of curvature (cm) of the curled surface of cast coated paper cut into a square of 10 cm × 10 cm, which was left in an air-conditioned room at a temperature of 20° C. and R.H. of 60% for a period of 24 hours. As the value increases, the paper is flatter.

EXAMPLE 7, COMPARISON EXAMPLE 4

Figure 2:
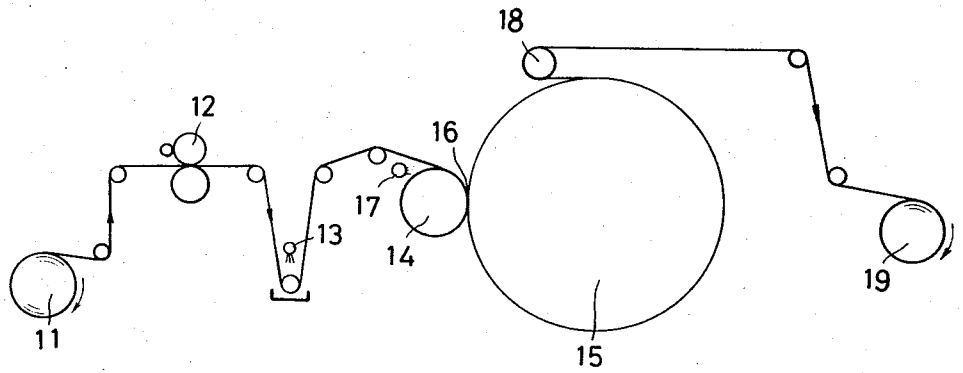

75 parts of kaolin, 20 parts (solid matter) of natural ground calcium carbonate dispersion containing particles less than 2 microns in diameter in a proportion of 95%, and 5 parts of aluminum hydroxide were dispersed by means of dispersants comprising 0.5 part (solid matter) of sodium polyacrylate and 0.5 part of sodium pyrophosphate so as to obtain a pigment slurry having a concentration of 70%. 13 parts of casein aqueous solution having a concentration of 15%, and 17 parts (solid matter) of styrene butadiene copolymer latex were mixed in said slurry, and 0.25 part of ammonium oleate was mixed in the resultant mixture so as to obtain a coating composition having a concentration of 55%. This coating composition had a pH value of 9.0 and a viscosity of 1500 cps (measured by a Brookfield viscometer at 60 r.p.m. and 20° C.). A gel-casting method was carried out by an apparatus shown in FIG. 2 with the coating composition. The coating composition was applied by a roll coater 12 onto the base paper 11 having a basis weight of 90 g/m$^2$ so that the dry coating weight becomes 25 g/m$^2$, and the coated layer was subsequently gelled by bringing it into contact with formic acid aqueous solution 13 having a concentration of 0.5%. At a pressing nip 16 formed by a pressing roll 14 having a diameter of 800 mm and a casting drum 15 having a diameter of 3000 mm and a surface temperature of 98° C., the gelled coated layer was pressed against the casting drum 15 at a pressure of 100 kg/cm, while 5 g/m$^2$ of oxidized starch aqueous solution having a concentration of 0.5% was sprayed onto the back surface of the paper by means of a spray 17. Then, the paper was dried, and released from the casting drum 15 by a takeoff roll 18 at a casting speed of 60 m/min. The paper was wound into cast coated paper 19. The obtained cast coated paper did not form any CD curl but had high gloss. In Comparison Example 4 in which the application of oxidized starch aqueous solution to the back surface of the paper in Example 5 was omitted, the paper formed a remarkable CD curl having a radius of curvature of less than 2 cm.

What is claimed is:

1. A process for eliminating cross-direction curl of cast coated paper produced by the gel-casting method and by the rewet-casting method, wherein a web of paper carrying a layer of coating comprising a pigment component and a binder component is pressed, while said coating is in a plasticized condition, into adherent contact with a highly polished heated drum and dried in contact therewith until said coated web releases therefrom, the improvement which comprises wetting the back surface of said web of paper with water in an amount of 1 to 30 g/m$^2$ at or before the nip where said coating layer is pressed against the surface of said drum.

2. The process as claimed in claim 1, wherein the surface temperature of said drum is above 90° C.

3. The process as claimed in claim 1, wherein the amount of water applied to the back surface of the paper is 3 to 15 g/m$^2$.

4. The process as claimed in claim 1, wherein the back surface of the paper is wetted by means of a water spray.

5. The process as claimed in claim 1, wherein the back surface of the paper is wetted by means of a wetting apparatus comprising a gravure roll, a pickup roll and a water pool.

6. The process as claimed in claim 1, wherein the back surface of the paper is wetted by means of a wetting apparatus comprising a plane roll, a pickup roll and a water pool.

* * * * *